US011246411B2

(12) United States Patent
Kampl

(10) Patent No.: US 11,246,411 B2
(45) Date of Patent: Feb. 15, 2022

(54) DRAWER SIDE WALL

(71) Applicant: Julius Blum GmbH, Hoechst (AT)

(72) Inventor: Markus Kampl, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/906,676

(22) Filed: Jun. 19, 2020

(65) Prior Publication Data

US 2020/0315346 A1 Oct. 8, 2020

Related U.S. Application Data

(63) Continuation of application No. PCT/AT2018/060294, filed on Dec. 12, 2018.

(30) Foreign Application Priority Data

Dec. 22, 2017 (AT) ..... A 51079/2017

(51) Int. Cl.
*A47B 88/90* (2017.01)
*A47B 96/20* (2006.01)

(52) U.S. Cl.
CPC ..... *A47B 88/90* (2017.01); *A47B 96/20* (2013.01)

(58) Field of Classification Search
CPC ..... A47B 88/90; A47B 96/20
USPC ..... 312/330.1, 234
See application file for complete search history.

(56) References Cited

U.S. PATENT DOCUMENTS 4,230,382 A * 10/1980 Wenzlick ..... A47B 88/944 248/223.41
4,379,603 A * 4/1983 Johnson ..... A47B 95/02 16/415
4,832,423 A * 5/1989 Rapp ..... G09F 7/10 312/348.4
4,848,860 A 7/1989 Röck et al.
5,197,791 A 3/1993 Domenig
5,370,454 A 12/1994 Domenig
6,053,593 A * 4/2000 Rock ..... A47B 88/95 312/348.2
2006/0049730 A1 3/2006 Sutterlutti
(Continued)

FOREIGN PATENT DOCUMENTS

AT 007 847 10/2005
DE 88 05 236 6/1988
DE 40 16 452 9/1991
(Continued)

OTHER PUBLICATIONS

International Search Report dated Feb. 28, 2019 in International (PCT) Application No. PCT/AT2018/060294.

*Primary Examiner* — James O Hansen

(74) *Attorney, Agent, or Firm* — Wenderoth, Lind & Ponack, L.L.P.

(57) ABSTRACT

A drawer side wall has an outer wall which has an exterior viewing surface and a rear side facing away from the exterior viewing surface, and has a cover which has a fastener, by which the cover can be fastened to the rear side of the outer wall. A rear side of a viewing section of the cover is configured to bear against the outer wall, and two separate recesses are spaced apart from each other on the rear side of the outer wall. The fastener includes two separate elastic clamping lugs, each of which is configured to engage in an associated recess in order to fasten the cover in position to the drawer side wall.

15 Claims, 8 Drawing Sheets

(56) References Cited

U.S. PATENT DOCUMENTS

2014/0312756 A1 10/2014 Ng

FOREIGN PATENT DOCUMENTS

| | | |
|---|---|---|
| DE | 20 2014 101 848 | 7/2014 |
| DE | 10 2015 109 459 | 11/2016 |
| DE | 20 2016 107 059 | 4/2017 |
| WO | 2010/045782 | 4/2010 |

* cited by examiner

DRAWER SIDE WALL

BACKGROUND OF THE INVENTION

The present invention concerns a drawer side wall, in particular a double-walled drawer side wall, comprising an outer wall which has an outwardly disposed viewing surface and a rear side facing away from the viewing surface, and a cover having fixing means, by means of which it can be fixed to the rear side of the outer wall, wherein a viewing portion of the cover bears with its rearward side against the outer wall. The invention further concerns a cover for such a drawer side wall.

A cover of that kind are usual in drawers in order to fit corporate logos or other items of information at their viewing portion. The cover are intended to be preferably releasably connected to the drawer but nonetheless to hold well in position in operation. It is also desirable if the drawers give an aesthetically attractive impression even without the cover.

For the last-mentioned reason there has been a trend to fixing the cover to the rear side of the outer wall by way of fixing means so that the outwardly disposed viewing surface of the outer wall no longer has to be provided with ugly recesses or other fixing elements.

SUMMARY OF THE INVENTION

The object of the invention is to provide a drawer side wall and an associated cover, with which it is possible to easily mount the cover and nonetheless ensure secure positioning of the cover on the drawer side wall.

According to the invention, two mutually spaced separate recesses are provided at the rear side of the outer wall of the drawer side wall. In the case of drawer casings, which are mostly made from thin metal sheet, the two recesses provides stability advantages over a larger, for example, slot-like recess. In the subject of the invention, associated with the two spaced separate recesses on the cover are two elastically resilient separate clamping lugs, of which each one engages into one of the two recesses and thus permits secure positioning of the cover.

The cover according to the invention can be pushed on from below over the lower longitudinal edge of the outer wall of the drawer side wall. If the position of the clamping lugs—viewed in the longitudinal direction of the drawer—relative to the corresponding recesses already matches they simply latch into the recesses and thereby fix the cover reliably and accurately in position on the drawer side wall which holds there substantially in clamping relationship. It is however also possible for the cover to be firstly fitted at any location to the drawer side wall (in particular to be pushed on from below) and then displaced in the drawer longitudinal direction until the clamping lugs latchingly engage into the associated recesses and the cover is thereby correctly positioned.

The relative dimensioning of the recesses and the parts of the clamping lugs, that engage thereinto, are so selected that the clamping lugs can engage with slight lateral play to ensure reliable latching engagement. It will be noted however that the dimensions of the recesses should not be much greater than the engaging parts of the clamping lugs to ensure exact positioning. The lateral play which is given by the difference in size of the recesses relative to the engaging parts of the clamping lugs is desirably between 1/10 mm and 3 mm.

The recesses can preferably be provided on a flanged-over region of the outer wall. There the recesses can be in the form of through openings which however only pass through the flanged-over region while the viewing surface of the outer wall remains intact. Such openings can be produced relatively easily by mechanical processes, for example stamping. The depth of the recesses is well defined and precisely corresponds to the material thickness (sheet thickness) of the flanged-over portion. Such recesses can be particularly easily produced if they are substantially rectangular and are open towards the longitudinal edge of the flanged-over portion. That facilitates the stamping process. The rectangular shape also gives defined straight edges which permit accurate positioning of the cover element or the clamping lugs engaging therein.

The cover according to the invention has preferably one, preferably flat, viewing portion which in the mounted state lies externally against the drawer and for example can bear a corporate logo or another item of information. That viewing portion is then adjoined preferably downwardly viewed in a cross-section by a substantially U-shaped profiled connecting portion which can be fitted from below on to the longitudinal edge of the outer wall. Finally the two resilient clamping lugs are preferably adapted to be connected to the connecting portion and extend parallel to the rearward side of the viewing portion.

Such cover can be produced in one piece for example from metal or plastic. The resilient configuration derives from the material property of sheet metal or plastic itself. It is desirable for the two resilient clamping lugs to be provided respectively at the front and rear ends of the cover, that is to say at a large spacing relative to each other, to ensure non-twisting fitment.

At their free ends the clamping lugs preferably have a clamping nose which projects towards the viewing portion of the drawer side wall and which engages into the recesses of the drawer side wall and is held there in clamping relationship.

For easier assembly it is desirable if those clamping noses have an inclined surface, wherein a particularly preferred embodiment provides that the inclined surface is doubly inclined or slanted, once in relation to the longitudinal direction of the cover, that coincides with the longitudinal direction or extension direction of the drawer. That makes it easier for the cover, once it has been pushed from below on to the outer wall of the drawer side wall, to be displaced in the longitudinal direction, more specifically even from an initially completely wrong position, in which case in the displacement movement the first clamping lug firstly drops into the second recess provided for the second clamping lug. By way of the above-mentioned inclined surface the first clamping lug can be disengaged out of that second recess again by further displacement until it finally moves into its position in the correct first recess, at which moment the second clamping nose also drops into the second recess and is held there in clamping relationship. That defines the correct position of the cover in the longitudinal direction.

The inclined surface is also oriented inclinedly towards the side edges of the cover, which allows the cover to be easily pushed from below on to the lower longitudinal edge of the outer wall of the drawer side wall. In that case the clamping lugs are firstly spread open somewhat. When subsequently the clamping noses reach the recesses they engage resiliently clampingly into the recesses and hold the cover clampingly to the drawer side wall, in which case the connection, besides the clamping action which provides a force-locking connection, also has a positively locking component, wherein the edges of the recesses co-operate with the non-inclined edges of the latching noses and thus ensure a positively locking position of the cover in the longitudinal direction.

BRIEF DESCRIPTION OF THE DRAWINGS

Further advantages and details of the invention are described more fully by means of the specific description hereinafter.

DETAILED DESCRIPTION OF THE INVENTION

Figure 1:
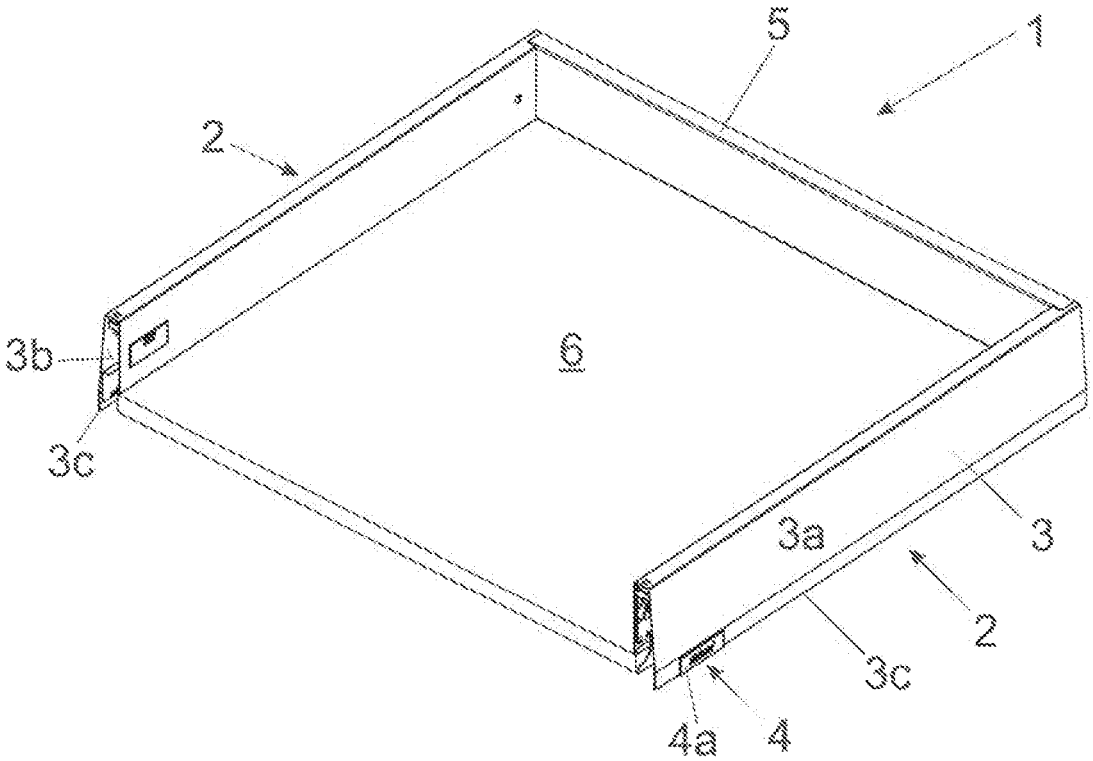
FIG. 1 is a perspective view of an embodiment of a drawer side wall on a drawer.

The drawer 1 shown in FIG. 1 has two oppositely disposed drawer side walls 2 in the form of double-walled drawer side walls 2. The outer wall is denoted by 3 and has an outwardly disposed viewing surface 3*a*. The rear side of the outer wall 3 is on the opposite side of that viewing surface 3*a*. A cover 4 having a viewing portion 4*a* which for example can carry a corporate logo or another item of information can be releasably connected to the outer wall 3 of the drawer side wall 2, as is described in greater detail hereinafter.

The drawer 1 shown in FIG. 1 also has a rear wall 5 and a drawer bottom 6. The front panel which can be releasably connected and which is necessary to make up a complete drawer 1 is not shown for the sake of clarity of the drawing. It is parallel to the rear wall 5 on the drawer 1 at the front.

Figure 2:
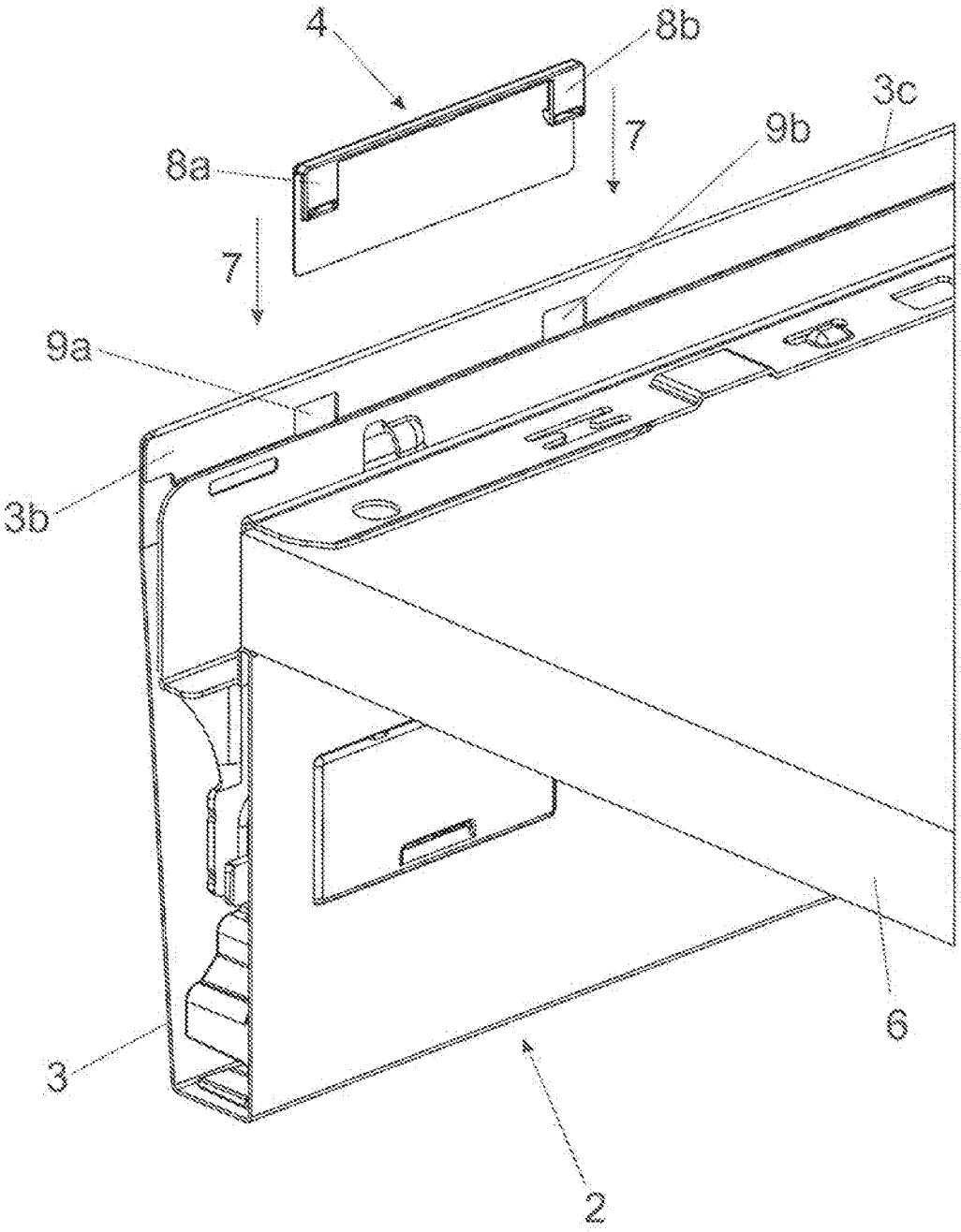
FIG. 2 shows a portion of a drawer side wall placed upside down with the cover as yet not fitted.

FIG. 2 shows a part of a drawer 1 which is placed upside down to be able to better see the underside. It will be appreciated that in practice the cover 4 can be pushed from below upwardly or in the longitudinal direction of the drawer, when the drawer 1 is in the normal position.

FIG. 2 shows how the cover 4 can be pushed in the direction of the arrows 7 on to the lower longitudinal edge 3*c* of the outer wall 3, more specifically in a position in which the separate resilient clamping lugs 8*a* and 8*b* according to the invention do not align with the two mutually spaced separate recesses 9*a*, 9*b* at the rear side 3*b* of the outer wall 3.

Figure 3:
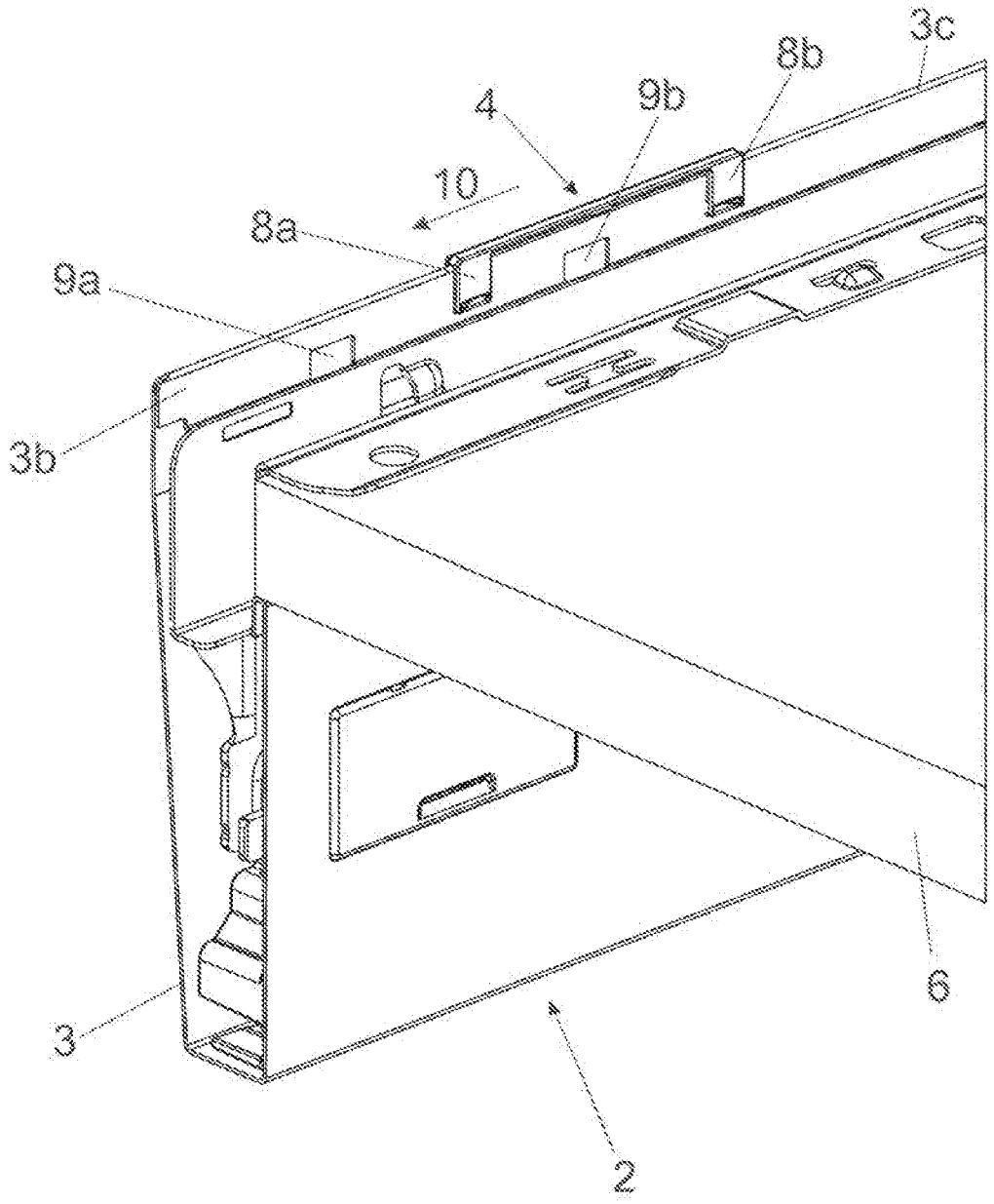
FIG. 3 is the same view as FIG. 2 with the cover already fitted on to the outer wall but not yet correctly positioned, FIG. 4 similarly to FIG. 2 shows the cover which has not yet been fitted in place at a location which is still further away from the correct position, FIG. 5 similarly to FIG. 3 shows the cover already fitted as shown in FIG. 4.
Figure 6:
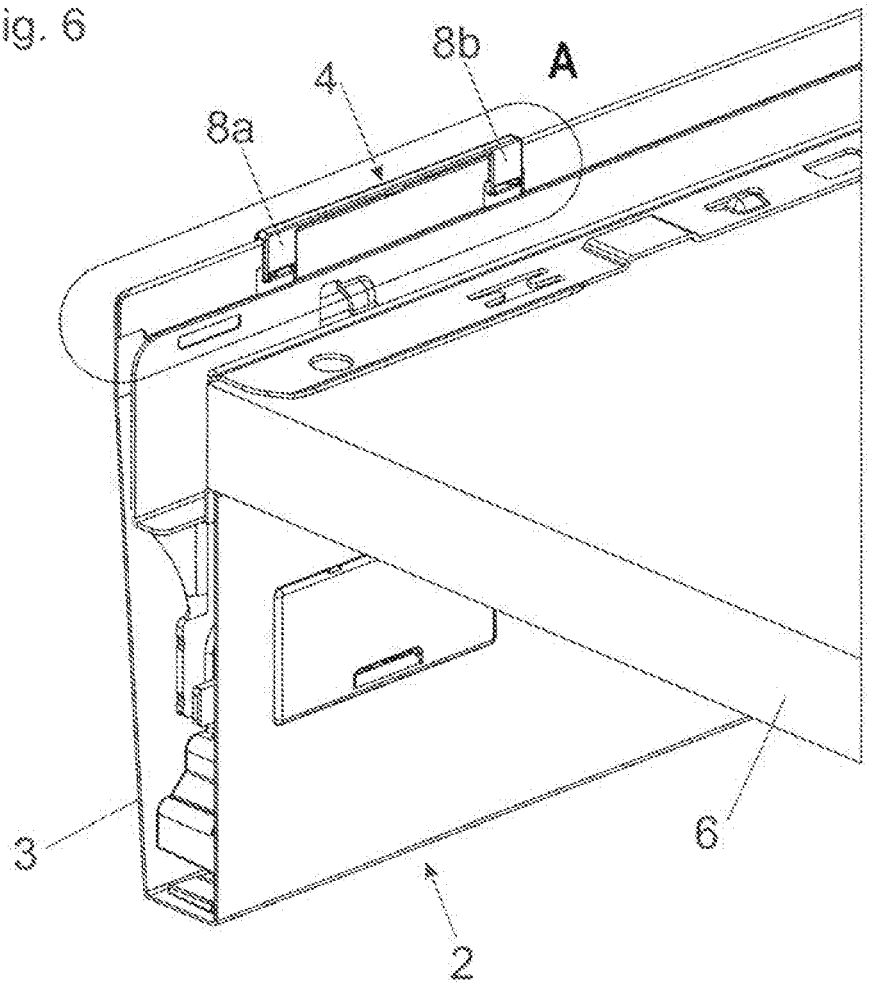
FIG. 6 shows the end position which can be achieved by displacement from the position in FIG. 3 or FIG. 5 of the correctly positioned cover.

Nonetheless, as shown in FIG. 3, the cover 4 can be pushed on to the longitudinal edge 3*c* in order then to be displaced in the direction of the longitudinal displacement arrow 10 until finally the desired, precisely defined end position is reached as shown in FIG. 6, which will be described in greater detail hereinafter.

Figure 4:
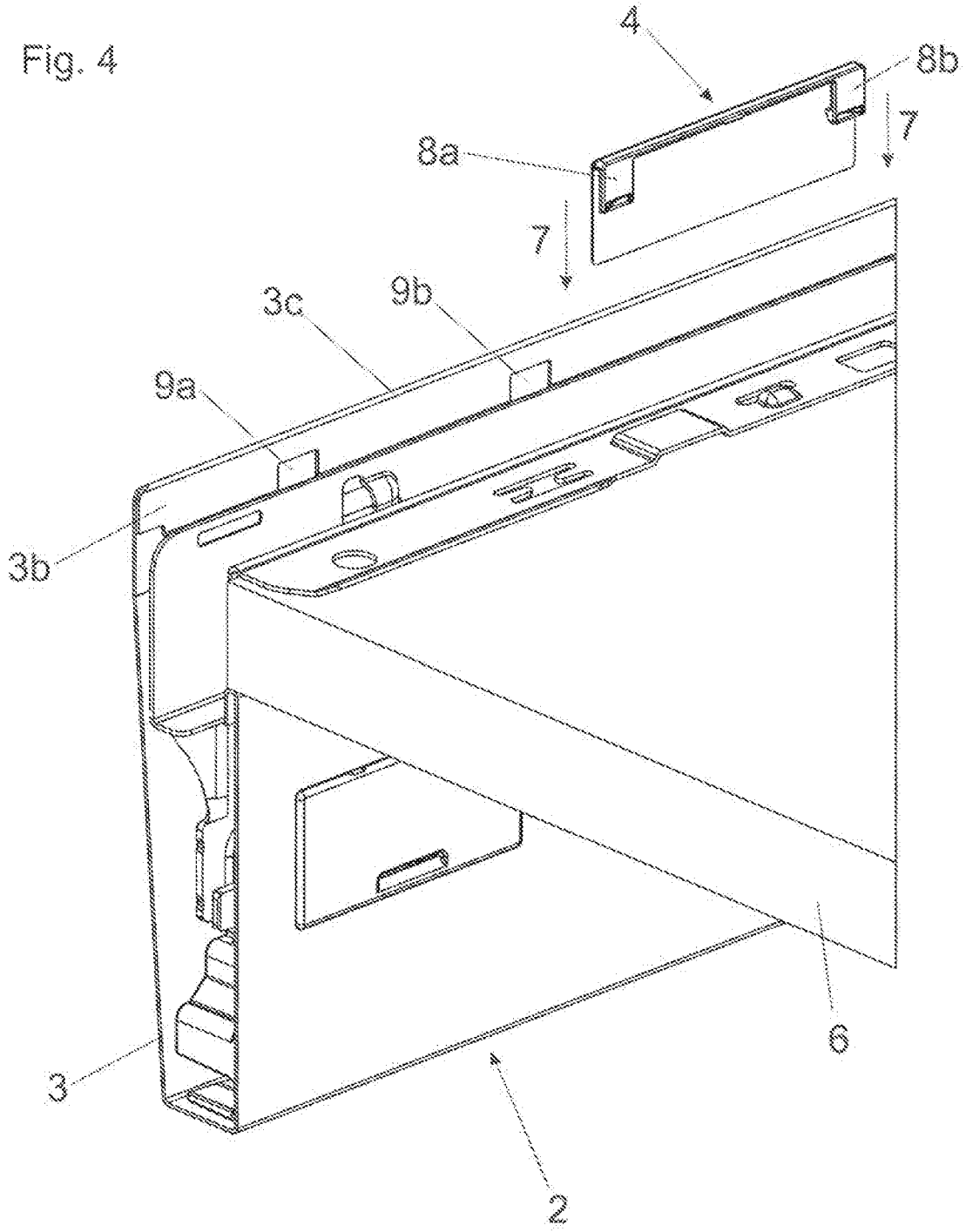
Figure 5:
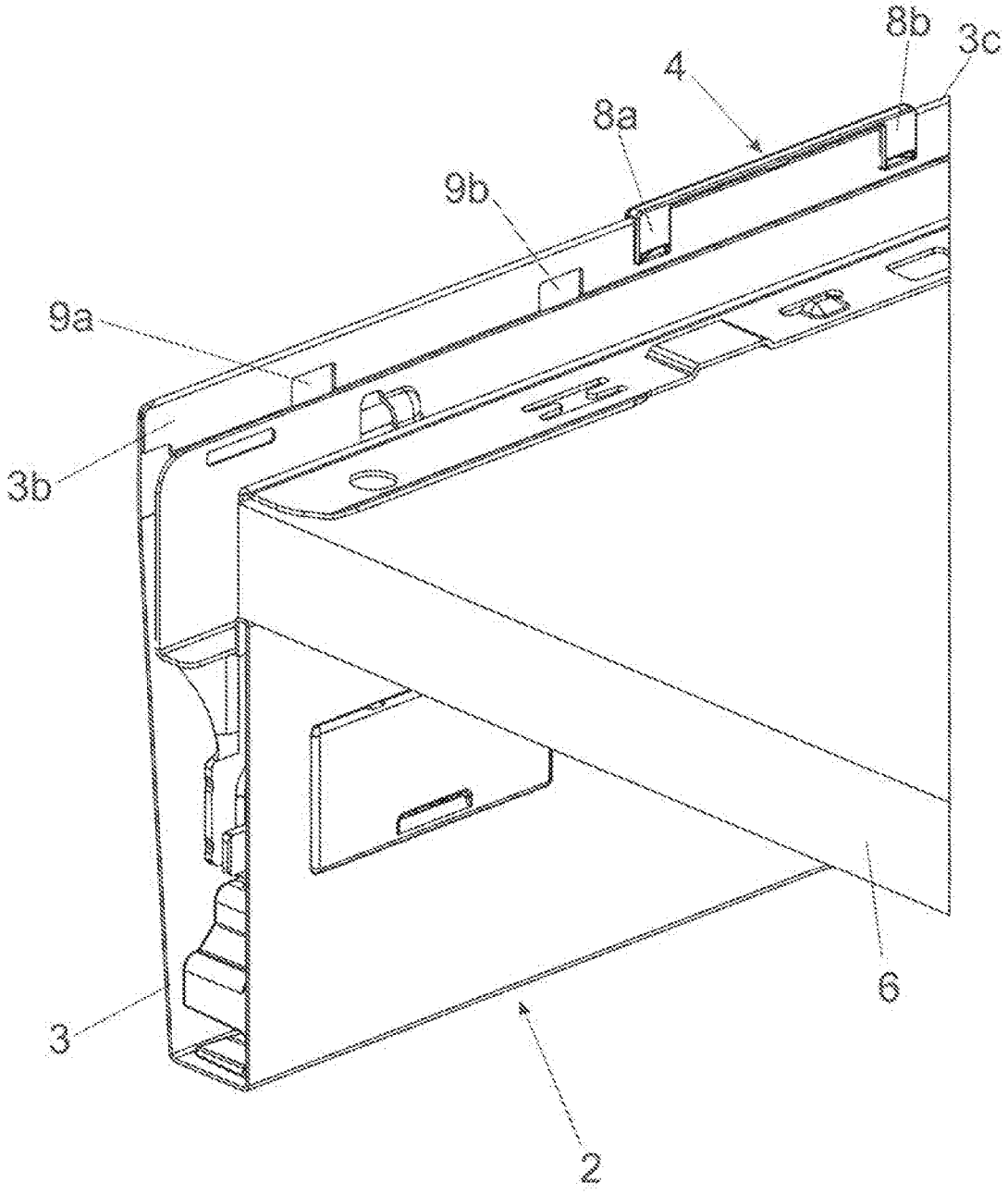

Pushing the cover 4 on and moving it longitudinally is possible even if, as shown in FIG. 4, it is pushed on to the longitudinal edge 3*c* still further at the rear, to firstly reach the position shown in FIG. 5. Upon being advanced into the FIG. 3 position the resilient clamping lug 8*a* firstly has to move beyond the 'wrong' recess 9*b*, which is achieved by virtue of the inclined surfaces 17 described hereinafter. Starting from the position shown in FIG. 3 it can then now be further pushed in the longitudinal direction as indicated by the longitudinal displacement arrow 10 until finally the front clamping lug 8*a* latches into the front recess 9*a* and the rear clamping lug 8*b* latches into the rear recess 9*b* and is held there in clamping and/or positively locking relationship. Exact longitudinal positioning of the cover 4 on the drawer side wall 2 is thus precisely ensured.

Figure 6A:
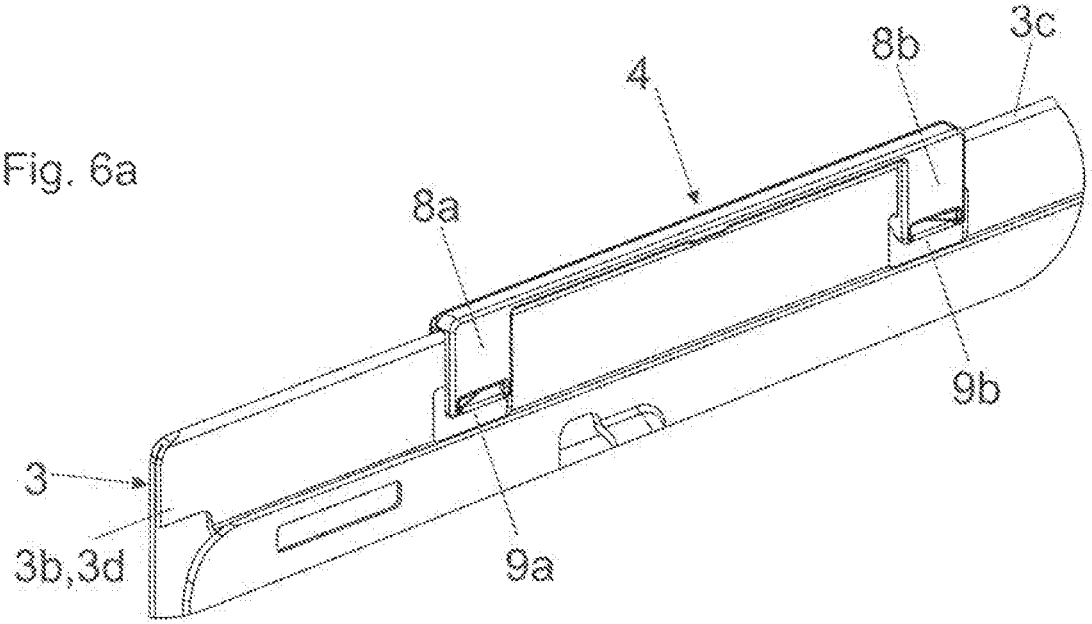
FIG. 6*a* is an enlarged view of a portion of FIG. 6, FIGS. 7*a* to 7*d* are various perspective views of an embodiment of a cover according to the invention.
Figure 7A:
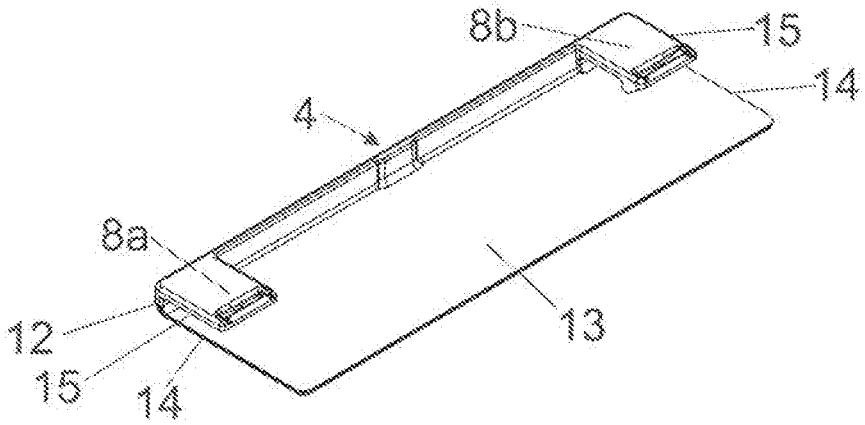
Figure 7B:
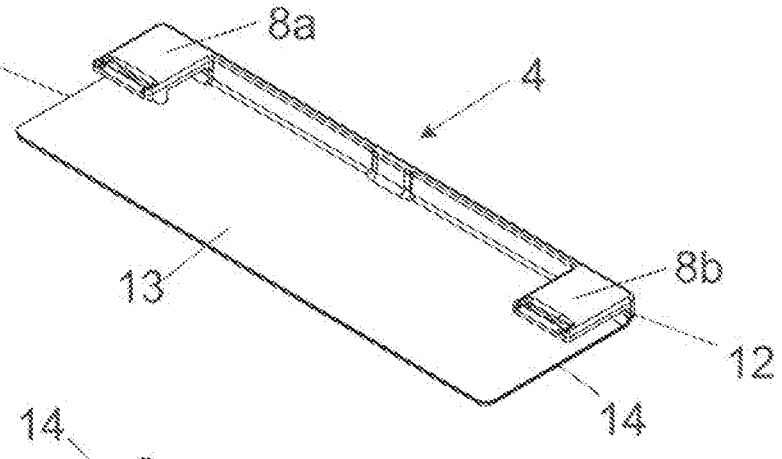
Figure 7C:
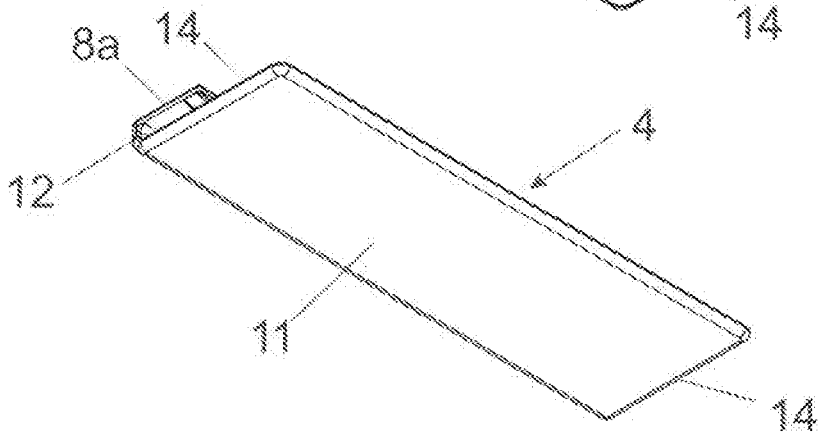
Figure 7D:
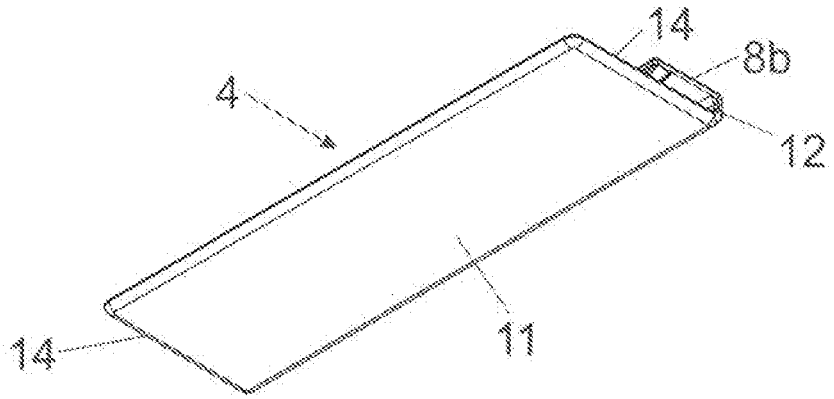

FIGS. 6 and 6*a* show the exactly positioned cover 4. At the rear side of the outer wall 3, that is generally indicated by reference 3*b*, the two clamping lugs 8*a* and 8*b* engage into the respective associated recesses 9*a* and 9*b* which are larger in the longitudinal direction with a small amount of play than the width of the clamping lugs 8*a*, 8*b*. By virtue of the material elasticity of the cover 4 which is preferably made in one piece from plastic the separate resilient clamping lugs 8*a* and 8*b* automatically snap into the recesses 9*a* and 9*b* and hold there securely in position.

As FIG. 6*a* in particular shows the outer wall 3 is flanged over at its longitudinal edge 3*c* to form a generally substantially U-shaped configuration.

The flanged-over portion 3*d* of the outer wall 3 preferably bears against the rearward side of the outer wall 3 provided with the viewing surface 3*a*, and thus forms the rear side 3*b* of the outer wall 3. The flanged-over configuration enables a stable structure for the longitudinal edge 3*c* without sharp-edged regions. In addition in an embodiment of the invention the flanged-over portion 3*d* makes it possible for the recesses 9*a* and 9*b* to be appropriately provided, more specifically in the form of through openings which for example can be stamped out. Those stamped-out openings are only provided in the flanged-over portion 3*d* and do not extend through the entire side wall for the rest of the outer wall 3 with the viewing surface 3*a* covers that opening and thereby in practice forms the bottom of those openings which then overall become the recesses 9*a* and 9*b*. Those recesses 9*a*, 9*b* are of a well-defined depth substantially corresponding to the thickness of the flanged-over material. As FIG. 6*a* shows those openings are of such a configuration that they extend to the edge of the flanged-over portion 3*d*, and therefore are open towards same.

The openings are desirably of the same shape and are rectangular, with the edges extending parallel and perpendicular to the longitudinal edge 3*c*.

Figure 8:
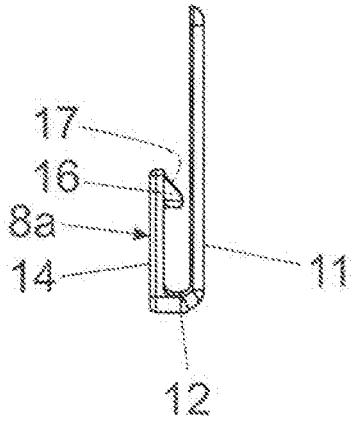
FIG. 8 is a front view of the cover of FIGS. 7*a* to 7*d*.
Figure 9:
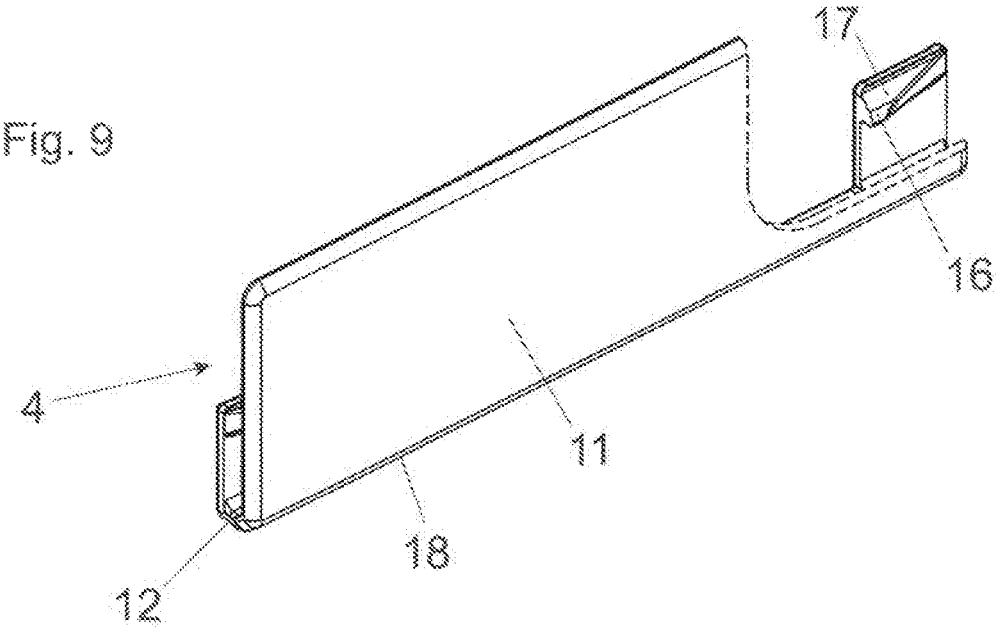
FIG. 9 is a perspective view with partly broken-way viewing portion to better show the clamping lugs with clamping nose and the inclined surface thereof.
Figure 10:
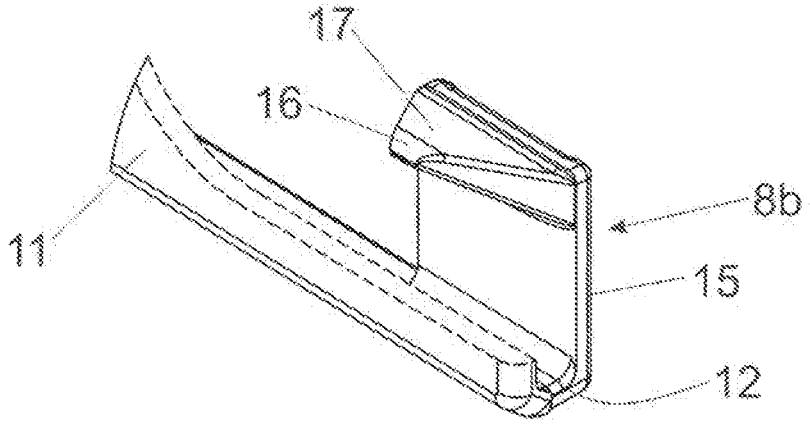
FIG. 10 is another perspective view of a part of FIG. 9.

An embodiment of a cover 4 according to the invention is shown in FIGS. 7*a* to 7*d* and in FIGS. 8, 9 and 10.

This embodiment has a viewing portion 11 which is preferably flat (disposed outwardly in the fitted state). That viewing portion 11 is adjoined by a connecting portion 12 of substantially U-shaped profile and which can be fitted on to the longitudinal edge 3*c* of the outer wall 3. In addition according to the invention there are two resilient clamping lugs 8*a* and 8*b* which are connected to the connecting portion 12 and extend substantially parallel to the rearward side 13 of the viewing portion 11. The clamping lugs 8*a* and 8*b* can preferably be produced in one piece with the other components of the cover 4 and acquire their elastic resilient action by virtue of elasticity of the material.

The two resilient clamping lugs 8*a* and 8*b* are respectively arranged in the region of the side edges 14 of the cover 4, giving an interposed free region. In regard to resistance to twisting of the fitted cover 4 such an arrangement of the resilient clamping lugs 8*a*, 8*b* which are spaced far apart is advantageous. They extend generally as far as the lateral edge of the cover 4, the side edges 14 of the cover 4 and the side edges 15 of the clamping lugs 8*a*, 8*b* preferably extending parallel to each other.

In the region of its free end each clamping lug 8*a*, 8*b* has a clamping nose 16 projecting towards the viewing portion 11 (see in particular FIGS. 8, 9 and 10).

The clamping nose 16 has an inclined surface 17 which on the one hand extends inclinedly relative to the side edge 14—preferably at an angle of 20° to 60°—as FIG. 8 shows. That makes it easier to push the cover 4 on, for example as shown in FIG. 2, in the direction of the arrows 7. In that case the clamping lugs 8*a* and 8*b* which are resiliently elastic are firstly bent open until finally in the end position shown in FIG. 6 and FIG. 6*a* respectively they can latchingly engage into the recesses 9*a* and 9*b*.

On the other hand the inclined surface 17 which can also be formed by a plurality of surface portions also extends inclinedly in another sense, more specifically inclinedly relative to the longitudinal direction 18 of the cover 4. That longitudinal direction 18 coincides with the longitudinal direction of the drawer and the direction of the longitudinal edge 3*c* of the outer wall 3, in terms of the direction involved. That inclined positioning makes it possible to go from FIG. 5 into FIG. 6, in which case the clamping lug 8*a* which latches firstly (incorrectly) into the recess 9*b* can disengage again upon being further pushed in the direction of the longitudinal displacement arrow 10 because the inclined surface 17 permits that disengagement. In that way it is possible for cover 4 which are even firstly completely wrongly fitted on to the longitudinal edge 3*c* always to be displaced in the longitudinal direction until the correct clamping lugs 8*a*, 8*b* latchingly engage into the correct recesses 9*a*, 9*b* and thus a defined position is achieved. That occurs in principle not just by displacement of the cover 4 from the rear forwardly (that is to say in the extension direction of the drawer 1) but also from the front rearwardly, that is to say in the opposite direction, for the inclined positioning of the inclined surface 17 with respect to the longitudinal direction 18 of the cover 4 is of a mirror-symmetrical configuration at both clamping lugs 8*a* and 8*b* with respect to a notional central plane between the two clamping lugs 8*a*, 8*b*.

LIST OF REFERENCES

1 drawer
2 drawer side wall
3 outer wall
3*a* viewing surface (of the outer wall 3)
3*b* rear side (of the outer wall 3)
3*c* longitudinal edge (of the outer wall 3)
3*d* flanged-over portion (of the outer wall 3)
4 cover
4*a* viewing portion (of the cover 4)
5 rear wall
6 drawer bottom
7 pushing-on arrow
8*a*, 8*b* clamping lugs (fixing means)
9*a*, 9*b* recesses
10 longitudinal displacement arrow
11 viewing portion
12 connecting portion
13 rearward side
14 side edges (of the cover 4)
15 side edges (of the clamping lugs 8*a*, 8*b*)
16 clamping nose
17 inclined surface
18 longitudinal direction (of the cover 4)

The invention claimed is:

1. A drawer side wall, comprising:

an outer wall which has an exterior viewing surface and a rear side facing away from the exterior viewing surface; and a cover having a fastener by which the cover can be fixed to the rear side of the outer wall, wherein:

a rear side of a viewing section of the cover is configured to bear against the outer wall;

two recesses are provided at the rear side of the outer wall, the two recesses being separate and spaced apart from each other;

the fastener includes two elastically resilient clamping lugs for fixing the cover in position to the drawer side wall, the two elastically resilient clamping lugs being separate and spaced apart from each other;

a first of the two elastically resilient clamping lugs is configured to engage from the rear side of the outer wall into a first of the two recesses;

a second of the two elastically resilient clamping lugs is configured to engage from the rear side of the outer wall into a second of the two recesses;

a lower longitudinal edge of the outer wall is flanged over in a substantially U-shaped configuration so as to define a flanged-over portion;

the flanged-over portion is configured to bear against the rear side of the outer wall and the two recesses are provided on the flanged-over portion;

the two recesses are openings which pass through the flanged-over portion and are covered by the rear side of the outer wall; and the openings extend to the lower longitudinal edge of the outer wall and are open towards the lower longitudinal edge of the outer wall.

2. The drawer side wall according to claim 1, wherein the two recesses are of substantially a same shape.

3. The drawer side wall according to claim 1, wherein:

the cover further includes a connecting portion which, viewed in cross-section, is of a substantially U-shaped profile and can be fitted onto the lower longitudinal edge of the outer wall, and the two elastically resilient clamping lugs are connected to the connecting portion.

4. The drawer side wall according to claim 3, wherein the viewing section is flat.

5. The drawer side wall according to claim 3, wherein the two elastically resilient clamping lugs extend substantially parallel to the rear side of the viewing section.

6. The drawer side wall according to claim 1, wherein the cover is in one piece.

7. The drawer side wall according to claim 1, wherein the two elastically resilient clamping lugs are arranged at a side edge of the cover.

8. The drawer side wall according to claim 1, wherein side edges of the cover and side edges of the two elastically resilient clamping lugs are parallel.

9. The drawer side wall according to claim 1, wherein the two elastically resilient clamping lugs are of substantially a same configuration or of a same mirror image-reversed configuration.

10. The drawer side wall according to claim 1, wherein each of the two elastically resilient clamping lugs has a clamping nose at a free end thereof which projects towards the viewing section.

11. The drawer side wall according to claim 10, wherein the clamping nose has at least one inclined surface.

12. The drawer side wall according to claim 11, wherein the at least one inclined surface extends inclinedly relative to a side edge of the cover.

13. The drawer side wall according to claim 12, wherein the at least one inclined surface extends inclinedly relative to the side edge of the cover at an angle of 20° to 90°.

14. The drawer side wall according to claim 11, wherein the at least one inclined surface extends inclinedly relative to a longitudinal direction of the cover.

15. The drawer side wall according to claim 14, wherein the at least one inclined surface extends inclinedly relative to the longitudinal direction of the cover at an angle of 5° to 20°.

* * * * *